US005752367A

United States Patent [19]

VerMehren

[11] Patent Number: 5,752,367

[45] Date of Patent: May 19, 1998

[54] AUTOMATED APPARATUS AND METHOD FOR PACKAGING GRANULAR MATERIALS

[76] Inventor: H. Richard VerMehren, 3620 Buford Dr., Pensacola, Fla. 32504

[21] Appl. No.: 744,925

[22] Filed: Nov. 6, 1996

[51] Int. Cl.[6] ..... B65B 1/06; B65B 1/36

[52] U.S. Cl. ..... 53/473; 53/168; 53/251; 53/260

[58] Field of Search ..... 53/473, 475, 467, 53/260, 255, 247, 301, 168, 249, 250, 251, 235

[56] References Cited

U.S. PATENT DOCUMENTS

| | | | |
|---|---|---|---|
| 702,347 | 6/1902 | Dodge et al. . | |
| 875,307 | 12/1907 | Wilson . | |
| 1,253,254 | 1/1918 | King . | |
| 2,006,450 | 7/1935 | Gaynor | 53/301 |
| 3,119,212 | 1/1964 | Zytka et al. | 53/473 X |
| 3,683,584 | 8/1972 | Tigner | 53/473 |
| 4,979,353 | 12/1990 | Seppala | 53/260 X |
| 5,257,494 | 11/1993 | Parrier et al. | 53/168 X |
| 5,267,426 | 12/1993 | Davis | 53/168 X |

*Primary Examiner*—James F. Coan

*Attorney, Agent, or Firm*—Thomas, Kayden, Horstemeyer & Risley

[57] ABSTRACT

An apparatus (5) for packaging generally granular materials is disclosed. The apparatus includes a structural framework (7) on which a feed hopper (8) is mounted, the feed hopper being supplied with the material to be packaged, and storing the material therein. A fill hopper assembly (11) is supported on the framework with respect to the feed hopper, and has a spaced pair of fill hoppers (31, 32) received thereon. As spaced pair of discharge chutes (15, 16) are also supported on the framework, and are offset with respect to the feed hopper. Each one of the fill hoppers is alternately moved into alignment with the feed hopper and into alignment with one of the discharge chutes, respectively, in reciprocable fashion on the framework. Each one of the fill hoppers includes a gravity actuated trap door (44, 45) constructed and arranged to be held in a substantially sealed and closed position on the fill hopper as it is aligned with the feed hopper, and constructed and arranged for movement into an opened position within one of the discharge chutes, respectively, as the fill hopper is aligned over the discharge chute for transferring material from the fill hopper into the discharge chute and toward one of a number of containers (20) provided for receiving the material therein.

27 Claims, 7 Drawing Sheets

AUTOMATED APPARATUS AND METHOD FOR PACKAGING GRANULAR MATERIALS

FIELD OF THE INVENTION

This invention relates in general to packaging machinery. More particularly, this invention relates to an automated apparatus for packaging a generally granular material in a variety of containers, and a method of using the automated apparatus for packaging granular materials.

BACKGROUND OF THE INVENTION

The use of packaging machines for packaging a diverse range of products is well-known in the art. Packaging machines have been developed for handling dry goods, bulk goods and prepared foodstuffs in a wide variety of industrial applications. One particular type of material, however, which is not well suited for use with the large variety of known packaging machines is granular materials, to include, for example, sand, sugar, and bulk granular products such as soy beans, grains, and corn. Oftentimes, these granular products will be packaged in cloth or plastic sacks, the granular material being passed through an open end of the sack, whereupon the sack is stitched or sealed shut.

In the patent to Dodge et al., U.S. Pat. No. 702,347 issued Jun. 10, 1902, for example, a feeding mechanism for conveyors is disclosed in which a pair of spaced feed hoppers are reciprocated in series over a continuous conveyor belt comprised of a spaced series of buckets linked together and into which two or more different types of materials, here anthracite and bituminous coal, are mixed within each individual bucket during its passage from the hoppers or bins to the point of discharge. Although providing a reciprocating feed hopper/fill hopper arrangement, which appears to be suitable for use with coarse granular products, for example coal, the apparatus of Dodge et al. does not appear to be well suited for use with more refined granular products.

Another type of conveyor loading device which may appear well suited for use with granular materials is disclosed in U.S. Pat. No. 875,307 to Wilson issued Dec. 31, 1907, in which a spaced series of buckets are moved along a conveyor line, each one of the buckets having a cross-axle supporting a spaced pair of roller wheels, the cross-axle being adapted to engage a cam lever for actuating a mechanically operated door on the discharge end of a feed hopper for supplying, and metering, the amount of material distributed to each one of the buckets in turn. Although the device of Wilson appears to be well suited for use with coarse granular or bulk products as opposed to more refined granular products, this device does not appear to be adapted for use in modem high speed packaging operations.

Another example of an early packaging/processing device adapted for use with string beans, rather than a granular soy beans, for example, is the bean snipping machine patent to King U.S. Pat. No. 1,253,254, issued Jan. 15, 1918. The machine of King uses a series of hoppers for receiving and feeding other hoppers, which in turn supply yet other hoppers for moving the string beans to a snipping machine which snips the ends of the beans off. Thus, although the bean snipping machine of King discloses the use of feed hoppers and fill hoppers, the feed hoppers being adapted for discharging the products into fill hoppers for transfer to yet another hopper, the device of King is not well suited for use with refined granular materials.

What is needed, therefore, but seemingly unavailable in the art is an automated apparatus constructed for the packaging of granular materials in modem high speed packaging operations where simplicity, durability, and ease of use are required in order to economically package high volumes of granular bulk goods. What is also needed, but unsatisfied by the known art, is a simple and automated apparatus for packaging granular materials which provides ease of use in combination with a rugged durable apparatus well-suited for continuous packaging operations.

SUMMARY OF THE INVENTION

The present invention provides an improved apparatus for packaging granular materials, and method of using same, which overcomes some of the design deficiencies of the known art. The improved apparatus for packaging granular materials of this invention allows greater ease of use, and thus flexibility, in order to help ensure that high volumes of granular materials can be easily, quickly, and accurately packaged thereon. Accordingly, the improved apparatus for packaging granular materials of this invention provides a new and improved method of packaging granular materials not heretofore known in the art.

The improved apparatus for packaging granular materials of this invention includes a framework, a feed hopper positioned on the framework with a supply of the granular material to be packaged in the feed hopper, and a supply of containers for receiving the granular material to be packaged therein. A fill hopper assembly is supported on the framework with respect to the feed hopper, the fill hopper assembly having at least one fill hopper sized and shaped to receive the granular material therein from the feed hopper. The apparatus further includes at least one discharge chute positioned on the framework and being offset with respect to the feed hopper, the discharge chute being constructed and arranged to direct the granular material therethrough and toward one of the containers for being packaged.

The fill hopper assembly is constructed and arranged to be moved on the framework from a first position in which the at least one fill hopper is aligned with the feed hopper in order to receive the granular material to be packaged therein, into a second position in which the at least one fill hopper is aligned with the at least one discharge chute for receiving the material discharged from the fill hopper, and for passage of the material toward one of the containers. The at least one fill hopper of the fill hopper assembly has a gravity actuated trap door hingedly connected thereto, the trap door being constructed and arranged for movement from a generally closed position in which the trap door is substantially sealed on the bottom of the fill hopper at the first position, into a generally open position in response to the movement of the fill hopper assembly, into the second position.

The fill hopper assembly is constructed and arranged, in a preferred embodiment, to be reciprocably moved from the first position into the second position, and back. In this embodiment, the fill hopper assembly includes a spaced pair of fill hoppers, and a spaced pair of discharge chutes, each one of the discharge chutes being offset with respect to the feed hopper. As one of the fill hoppers is being supplied with granular material from the feed hopper, the other of the fill hopper is aligned over one of the discharge chutes for discharging material therein, if any, into the discharge chute. The fill hoppers are then reciprocably moved into their alternate positions so that the first of the fill hoppers is aligned with the other one of the discharge chutes as the second fill hopper is simultaneously being supplied with granular material from the feed hopper. In this method of use, the feed hoppers are reciprocably and alternately positioned underneath the feed hopper, and over one of the discharge chutes.

In a second embodiment of the invention, the fill hopper assembly is constructed as a carousel having eight separate fill hoppers positioned about an axis of rotation, each one of the fill hoppers being spaced equally apart from each adjacent one of the fill hoppers radially about the axis of rotation. The fill hopper assembly is rotated, either continuously or intermittently, about the axis of rotation underneath the feed hopper. The feed hopper is provided with four feed hopper openings spaced radially and equally apart from one another about the axis so that a first series of fill hoppers comprised of every other one of the eight fill hoppers is aligned with the feed hopper openings and supplied with granular material therein. A second series of fill hoppers, comprised of the other every other one of the eight fill hoppers, is simultaneously aligned over one of four spaced discharge chutes, respectively, each one of the discharge chutes being offset with respect to each one of the feed hopper openings.

Accordingly, the method of using the second embodiment of this invention includes the steps of positioning the first series of fill hoppers at a first position and supplying each one of these fill hoppers with granular material from the feed hopper, and rotating the fill hopper assembly about the axis of rotation so that the first series of fill hoppers are moved out of alignment with the feed hopper openings and into alignment with the four spaced discharge chutes of the apparatus. The gravity trap doors of the first series of fill hoppers are moved from their substantially sealed and closed position on the fill hoppers at the first position into an opened position over each one of the discharge chutes at the second position so that the material contained within the fill hoppers is discharged through the chutes and toward one of a series of containers. Simultaneous with the rotation of the first series of fill hoppers, the second series of fill hoppers is rotated from out of alignment with each one of the spaced discharge chutes, respectively, so that the gravity trap door of each one of the second series of fill hoppers is closed in response thereto, whereupon the second series of fill hoppers is moved into alignment with the four feed hopper openings for receiving the granular material to be packaged therein.

Accordingly, it is an object of the present invention to provide an improved apparatus for packaging granular material, and method of using same, which automates the process of packaging granular materials.

Another object of the present invention is to provide an improved apparatus for packaging granular materials, and method of using same, having a simplified apparatus and method of use for greater reliability and efficiency in packaging operations.

Yet another object of the present invention is to provide an improved apparatus for packaging granular materials, and method of using same, which is well suited for use with a wide variety of granular materials.

Still another object of the present invention is to provide an improved apparatus for packaging granular materials, and method of using same, which is well suited for use with a large variety of containers for receiving the granular materials.

An additional object of the present invention is to provide an improved apparatus for packaging granular materials, and method of using same, which could be operated continuously, or intermittently, as desired.

Yet another object of the present invention is to provide an improved apparatus for packaging granular materials, and method of using same, which is inexpensive to manufacture, is simple to use, and is durable and rugged in structure and use.

Accordingly, these, and other objects and features of the invention will be realized in the improved apparatus for packaging granular materials, and method of using same, disclosed in the specifications and drawings, and described more fully hereinbelow.

DETAILED DESCRIPTION

Figure 1:
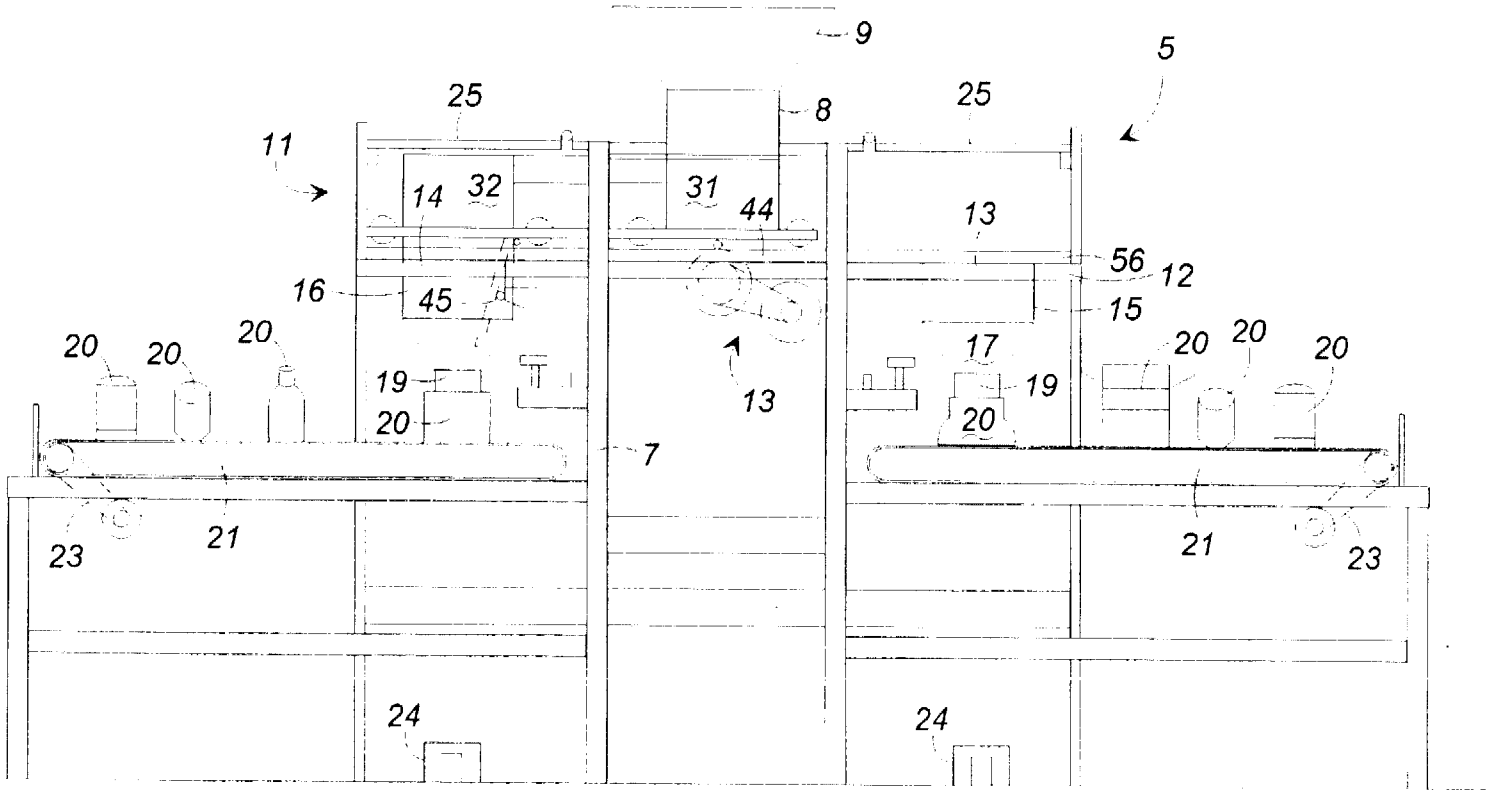
FIG. 1 is a side elevational view of a first embodiment of the apparatus for packaging granular materials of this invention.

Referring now to the drawings, in which like reference numerals indicate like parts throughout the several views, numeral 5 of FIG. 1 illustrates a preferred embodiment of the improved apparatus for packaging granular materials of this invention.

Apparatus 5 is supported on a conventional framework 7. As shown in FIG. 1, framework 7 is generally a structural steel framework, although other building materials are equally well suited for use in supporting the apparatus. Positioned atop framework 7 is a feed hopper 8, having a funnel 9 attached to, or formed as part thereof, for receiving the granular material to be packaged therein. Feed hopper 8 extends through a structural deck plate or grating (not illustrated) supported on the top of framework 7. Supported on framework 7 below feed hopper 8 is fill hopper assembly 11 constructed and arranged for reciprocable movement on framework 7 with respect to feed hopper 9. Fill hopper assembly 11 is supported on a stationary plate 12 affixed to framework 7. The stationary plate also supports a fill hopper drive assembly 13 constructed and arranged to reversibly drive i.e., reciprocate, fill hopper assembly 11 with respect to feed hopper 8.

Defined within stationery plate 12 are two openings (not illustrated) from which a first discharge chute 15 and a spaced second discharge chute 16 depend. Both discharge chutes 15 and 16 are offset with respect to feed hopper 8. Each one of the discharge chutes has a funnel 17 depending therefrom terminating in a throat 19 sized and shaped to supply the granular material to be packaged within any one of containers 20, as shown in FIG. 1. Containers 20 may comprise cloth or plastic sacks or bags, bottles, cans, cartons, or any other type of suitable container constructed for holding a generally dry granular material therein. Containers 20 are supported on one of conveyors 21, the conveyors being adapted to move filled containers 20 away from discharge chutes 15 and 16, respectively, and toward other parts, of the facility within which apparatus 5 is installed for further processing and/or handling. Each one of conveyors 21 is powered by a conventional conveyor drive assembly 23 having a motor supported on the framework, a drive sprocket mounted on the motor, and a spaced driven sprocket operably engaged with the conveyor belt and over which a drive belt is placed for powering each one of the conveyor belts, respectively.

Still referring to FIG. 1, framework 7 is provided with a pair of hinged inspection and/or access hatches 24 on each side of feed hopper 8 atop framework 7. Inspection hatches 24 are provided for inspecting the condition of fill hopper assembly 11, as well as its component parts, and/or for cleaning the fill hopper assembly between use.

Figure 2:
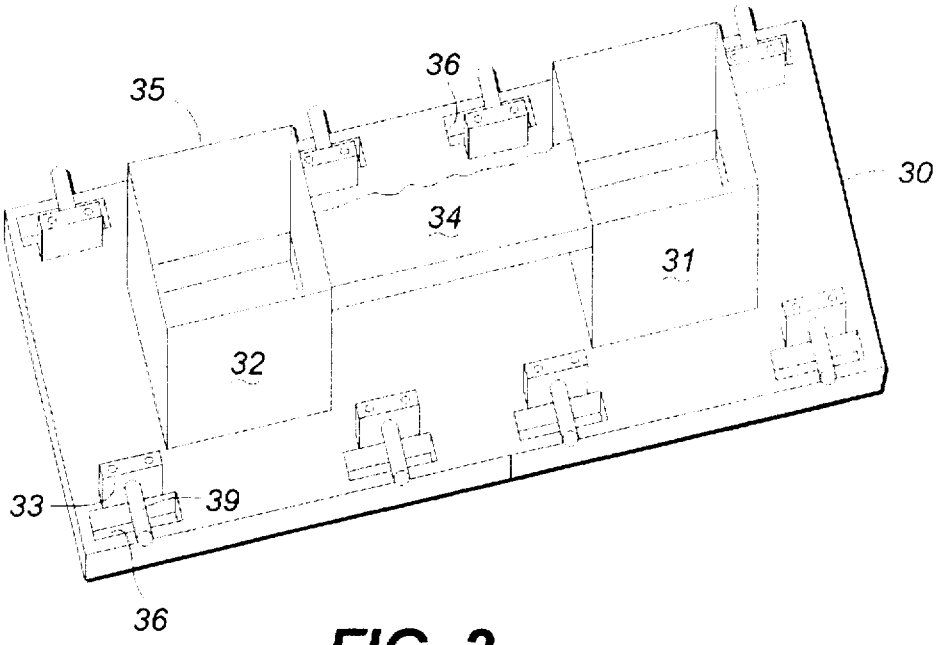
FIG. 2 is a partially cut-away top perspective view of the fill hopper assembly of the invention of FIG. 1.
Figure 3:
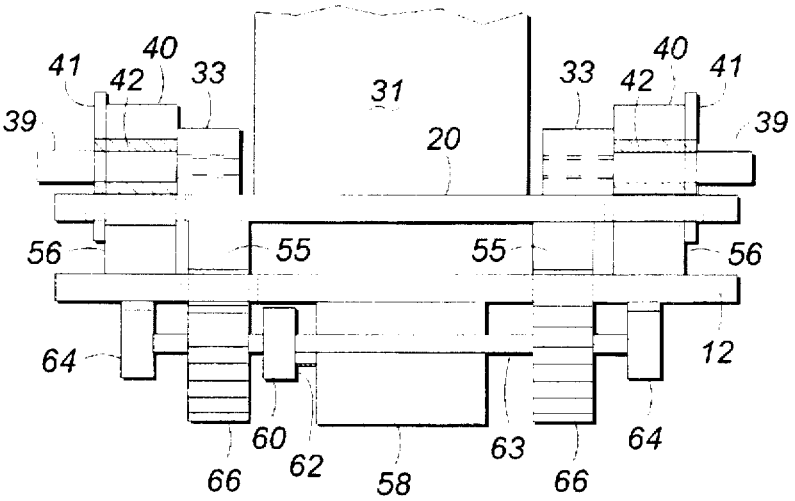
FIG. 3 is an end elevational view along line 3—3 of FIG. 1 illustrating a portion of the fill hopper assembly and the drive assembly of the invention.
Figure 4:
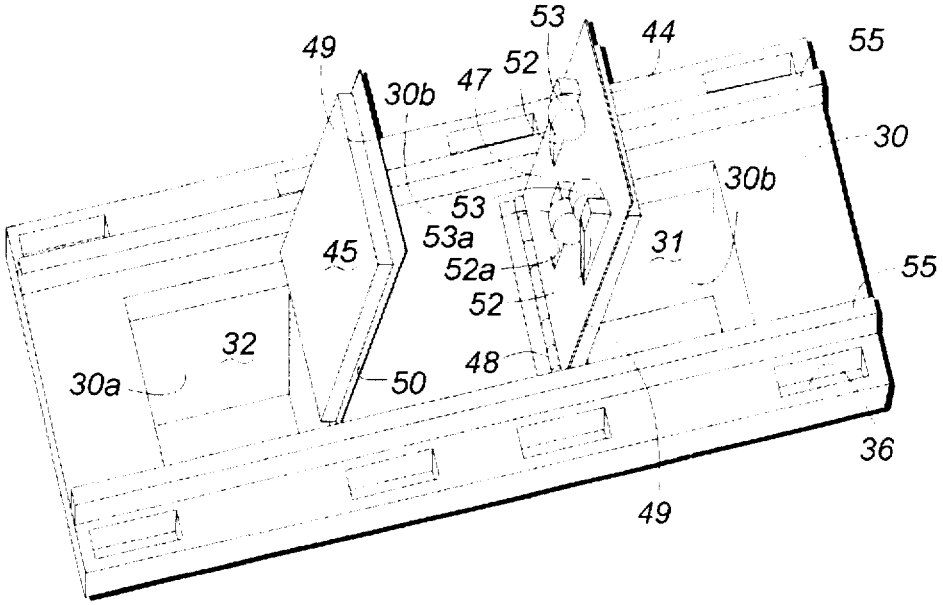
FIG. 4 is a bottom perspective view of the fill hopper assembly of FIG. 2.

Fill hopper assembly 11 is illustrated in greater detail in FIGS. 2–4. Referring now to FIG. 2, fill hopper assembly 11 has a generally rectangular and planar base plate 30 on which a first fill hopper 31 and a second fill hopper 32 are mounted and extend upward away from the base plate. Extending between each one of the fill hoppers is a top plate 34, the top plate being flush with a peripheral edge 35 along the top most portion of each of the fill hopper. Top plate 34 is provided for structural rigidity, as well as for use in sealing feed hopper 8 on the top plate as the fill hopper assembly is reciprocated beneath the feed hopper in fashion described in greater detail below.

Along the two elongated sides of base plate 30 are first and a second series of slotted openings 36 through which the support wheels 40 (FIG. 1, 3, 5, 6) pass. Accordingly, a support block 38 is mounted on the surface of base plate 30 adjacent each one of openings 36. Each one of support blocks 38 extends parallel to one each of slotted openings 36, and has a spindle 39 mounted centrally thereon and extending perpendicularly with respect to each one of the slotted openings. A support wheel 40 is received on each one of spindles 39 (FIG. 3).

Each one of support wheels 40 has a wheel flange 41 for being received on one of two spaced guide rails 56 (FIG. 3) mounted on the stationary plate, and supporting the fill hopper assembly for movement. Each one of wheels 40 is provided with a bearing assembly 42 affixed to spindle 39 and supporting each one of the wheels for rotation about the spindle. Each one of bearing assemblies 42 includes a central roller bearing (not illustrated), with a pair of opposed thrust bearings (not illustrated), facing toward support block 38 and a mounting collar (not illustrated) received on the free end of spindle 39, and being used for locking support wheel 40 in position on spindle 39 within one each of slotted openings 36. It is anticipated that the roller bearing (not illustrated) and the thrust bearing (not illustrated) which comprise bearing assembly 42 will be conventional ball bearing assemblies constructed for use in industrial applications and environments, and will be suitably sealed against dust and other debris in order to prolong the service life of the bearing assembly.

Referring now to FIGS. 1 and 4, and as best shown in FIG. 4, each one of fill hoppers 31 and 32 has a gravity actuated trap door 44, 45, respectively. Base plate 30 is provided with a pair of spaced openings sized and shaped to match the size of each one of fill hoppers 31, 32 mounted thereon. In turn, each one of gravity actuated trap doors 44, 45 is similarly sized and shaped so that it will seal flush on each one of the openings within base plate 30. It is anticipated that fill hoppers 31 and 32 can be constructed of any desired size and shape so long as they are capable of being generally sealed for holding the granular material to be packaged. Thus, although fill hoppers 31 and 32 are shown in FIG. 2 as having a square cross-section, it is anticipated that fill hoppers 31, 32 could be circular, or rectangular, or of any desired shape so long as a pair of corresponding openings is defined within base plate 30, and a pair of correspondingly sized and shaped gravity actuated trap doors 44 and 45 is provided for being sealed on the openings defined with base plate 30 in communication with each one of the fill hoppers.

Still referring to FIG. 4, each one of the gravity actuated trap doors is comprised of a generally square, in this instance, panel 45 fastened with a hinged connection 48 to one of the edges of the openings defined in the base plate. As shown in FIG. 4, the two gravity actuated trap doors will be mounted with their hinged joints 48 facing each other so that the trap doors are in a reverse position with respect to one another. Each one of hinge joints 48 is best likened to an elongated piano hinge, or similar type of hinge, and can be either welded, or fastened to base plate 30 and along the opposed end edges of the panels 47 of the two gravity actuated trap doors 44, 45, respectively.

Still referring to FIG. 4, a continuous and elongated edge flange 49 is formed along the remaining three edges, the two opposed side edges and the opposed end, of panel 47 opposite hinge joint 48. Edge flange 49 is formed so that as gravity actuated trap doors 44, 45 are forced into a closed position (FIGS. 1, 5, 6), the flange limits the movements of the panel 47 on the base plate for closing the open end of each one of fill hoppers 31, 32. In order to accomplish this task, a continuous and resilient gasket 50 is mounted on the side of edge flange 49 facing toward base plate 30 when the gravity trap doors are in their closed positions. It is anticipated that the material used to construct gasket 50 will be a rubber or resilient material, which may include any of the known rubbers, or current chemical compounds or polymers well suited for this task, for example, neoprene or other flexible and resilient rubber-like materials. It is anticipated that gasket 50 will be glued or chemically bonded to edge flange 49 so that it is permanently attached thereto.

Referring now to FIGS. 1 and 4, each one of gravity actuated trap doors 44, 45 is provided with three spaced skid plates, a leading skid plate **52*a*, and a trailing pair of parallel skid plates 52, each one of the three skid plates having a roller 53*a*, 53, respectively, mounted thereon. As described in greater detail below, when fill hopper assembly 11, and in particular base plate 30, is moved in position over one of discharge chutes 15, 16, the appropriate gravity actuated trap door is allowed to free fall downward into one of the discharge chutes so that the material held within the fill hopper will fall into the discharge chute to be passed therethrough toward and into one of containers 20. When base plate 30 is being moved into its alternate position, i.e., being reciprocated on stationary plate 12 from the first position to the second position, leading skid plate 52*a* will be the first skid plate to strike the edge of one of the discharge chute openings (not illustrated) defined within stationary plate 12 before its roller 53*a* strikes the edge of the opening to begin the transition of plate 47 into its closed position prior to the rollers 53 of the trailing pair of skid plates 52 striking the edge of the stationary plate/discharge chute opening. This will prevent the rollers from being otherwise caught on the edge of either of the openings defined within the stationary plate in order to prevent the rollers, and thus the base plate, from becoming locked or caught in a latched positioned on the stationary plate which would otherwise impede the reciprocation of the base plate to its fullest extent. Each one of rollers 53a, 53 is mounted on a spindle or shaft (not illustrated) received within or formed as a part of each one of skid plates 52a, 52 so that the rollers are free to rotate about the spindle. One suitable example of a roller suitable for use as roller 53a and 53 includes cam follower model number CRSL-14 manufactured and/or distributed by Torrington. Lastly, and as shown in FIGS. 3 and 4, the bottom surface of base plate 30, i.e., that surface facing stationary plate 12, is provided with a pair of spaced, elongated, and parallel gear racks 55, each of gear racks 55** being the equivalent of an elongated toothed gear.

Referring now to FIGS. 1 and 3, a pair of spaced, parallel, and elongated guide rails 56 are mounted on stationary plate 12 in alignment with the two series of support wheels 40 mounted on base plate 30 and extending through slotted openings 36, respectively. As shown in FIG. 3, wheel flange 41 of each support wheel 40 is on the outside edge or portion of each of the guide rails, respectively, for locking the fill hopper assembly in position on the guide rails so that the fill hopper assembly may move along the guide rails but may not be moved transversely with respect to the guide rails, thus moving out of alignment with feed hopper 8 and discharge chutes 15, 16.

Fill hopper drive assembly 13 is comprised of a drive motor 58 mounted on framework 7, having a drive sprocket 59 over which a drive belt 60 is passed. A drive sprocket 62 is mounted on a drive shaft 63 supported on a pair of spaced pillow blocks 64 and mounted to the bottom of stationary plate 12. Drive belt 60 is extended over both drive sprocket 59 and driven sprocket 62 so that the rotational movement of drive motor 58 will in turn rotate drive shaft 63, in turn rotating the two spaced drive gears 66 mounted on the drive shaft, and engaged one apiece with one each of gear racks 55, thus providing the drive assembly by which base plate 30, and in turn fill hopper assembly 11 is reciprocated on stationary plate 12 with respect to feed hopper 8 and discharge chutes 15, 16.

Figure 5:
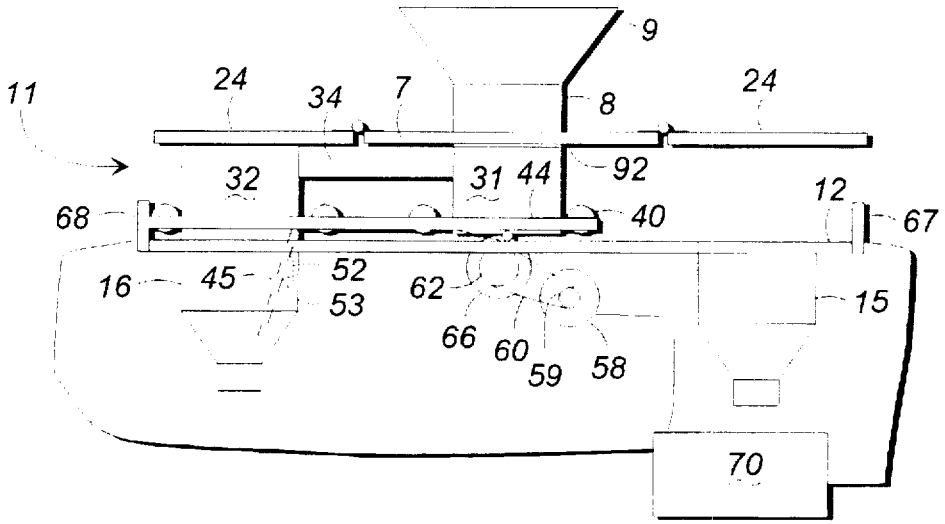
FIGS. 5 and 6 are sequential side-elevational views of the invention of FIG. 1 in use.
Figure 6:
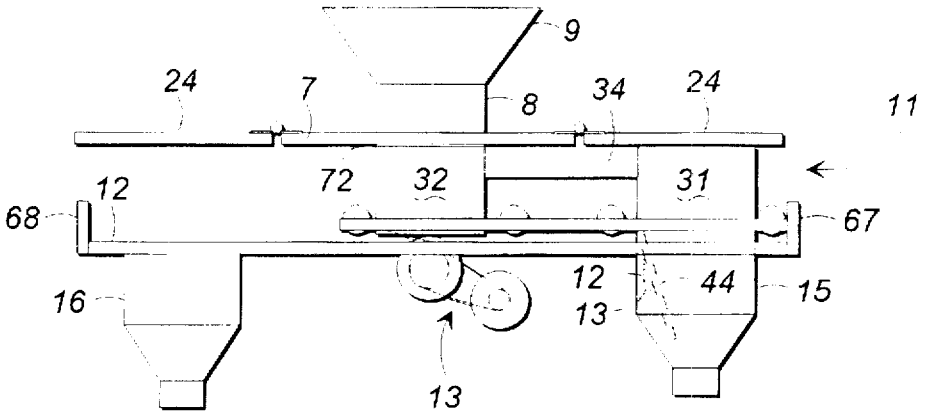

Referring now to FIGS. 5 and 6, a first reversing switch 67 and a spaced second reversing switch 68 are fastened one each to the opposed ends of stationary plate 12. Reversing switches 67 and 68 may be magnetic sensors, i.e., proximity switches, or may be photocells or other suitable switches, used to detect the presence of base plate 30 adjacent the reversing switch for signaling drive motor 58, through a relay 70 to reverse the direction of the drive motor for reciprocating the movement of the fill hopper assembly on the stationary plate and thus alternately positioning fill hoppers 31, 32 at feed hopper 8, respectively. It is anticipated that each one of reversing switches 67, 68 will have a time delay feature therein, so that the emission of its control signal to relay 70, and in turn to drive motor 58, will be delayed by an appropriate programmed period of time in order to delay or dwell the movement of fill hopper assembly 11 with respect to feed hopper 8, and the two discharge chutes to allow sufficient time to place an empty container 20 on the throat 19 of the respective discharge chute which will receive the next loaded one of the fill hoppers 31, 32.

Figure 7:
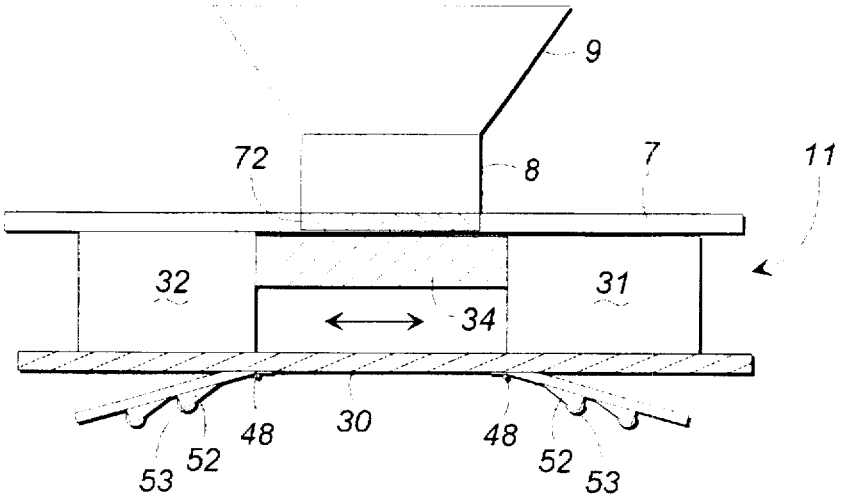
FIG. 7 is an enlarged partial detail view illustrating the manner in which the feed hopper of FIG. 1 is sealed on the fill hopper assembly of FIG. 1.

Referring now to FIG. 7, and as shown generally in FIGS. 5 and 6, a flexible seal 72 is mounted on the bottom peripheral edge of feed hopper 8 adjacent, i.e., juxtaposed on, top plate 34 when fill hopper assembly 11 is being reciprocated on the stationary plate. Flexible seal 72 is formed of a flexible and resilient material so that it acts as squeegee or seal to ensure that the granular material held within feed hopper 8 does not pass from the feed hopper when one of fill hoppers 31, 32 is not in registry with the feed hopper for receiving the material therein. Thus, it is anticipated that flexible seal 72 will be formed of a rubber or plastic foam to include neoprene or similar rubber-like materials as desired.

Although not shown in the drawings, it is anticipated that funnel 9 of feed hopper 8 will be provided with the granular material to be packaged by a conventional supply conveyor, which may include a belted conveyor, a bucket conveyor, a screw conveyor, a scraper flight conveyor, an apron or pan conveyor, or even a trough conveyor. It is also anticipated, although not illustrated, that feed hopper 8 could be supplied with the granular material to be packaged by a compressed air delivery system depending on the suitability of the granular material to be packaged for transmission via compressed air system.

It is also anticipated, although not specifically illustrated herein that a metering device could be formed as a part of feed hopper 8 to meter the amount of granular material passed into each one of fill hoppers 31, 32. In similar fashion, however, the amount of material metered into each one of the fill hoppers could be determined by the size of the fill hoppers so that granular material is allowed to flow from feed hopper 8 into the fill hoppers until the fill hopper is filled and the granular material stops to flow, whereupon flexible seal 72 in conjunction with top plate 34 will seal the feed hopper on the fill hopper assembly to prevent the spilling of material from the feed hopper as the fill hopper assembly is being reciprocated between discharge chutes 15, 16, and prior to feeding material to the second, or alternate fill hopper, on the fill hopper assembly.

Referring now to FIGS. 5 and 6, the operation of the first embodiment of apparatus 5 is illustrated. Referring first to FIG. 5, fill hopper assembly 11 is shown in a first position so that first fill hopper 31 is receiving granular material from feed hopper 8. In this position, first gravity actuated trap door 44 is held in its closed position substantially sealed on the bottom of base plate 30, roller wheels 53 of the gravity actuated trap door being received on stationary plate 12 so that the trap door is held in its closed position on the fill hopper. The second fill hopper 32 is shown with its gravity actuated trap door 45 extending down into discharge chute 16, with skid plate 52 shown adjacent one of the side walls of the discharge chute for spacing rollers 53 therefrom, for allowing gravity actuated trap door 45 to pass over the edge of the discharge chute opening once the movement of fill hopper assembly 11 started. After fill hopper 31 has been filled, motor 58 is actuated, either by an initial start command, or by a time delay signal emitted by reversing switch 68, so that the fill hopper assembly is reversed in position on stationary plate 11, and in particular moved by support wheels 40 on guide rails 56, so that first fill hopper 31 is now positioned in a second position over discharge chute 15, whereupon gravity actuated trap door 44 is allowed to fall downward into the discharge chute so that the granular material within the fill hopper 31 passes into the discharge chute therethrough toward and into one of the containers 20 (not illustrated) for being packaged.

Simultaneous with the movement of fill hopper 31 into position over discharge chute 15, however, second fill hopper 32 is moved into the first position aligned under feed hopper 8 so that it may be supplied with the granular material to be packaged. As the fill hopper assembly is reciprocated on the stationary plate, gravity actuated trap door 45 is moved into its closed position on the bottom of base plate 30 in alignment with fill hopper 32, and substantially sealed on the bottom of base plate 30 in registry with fill hopper 32 by the construction of rollers 53 and skid plate 52, coupled with the spacing of base plate 30 from stationary plate 12, such that panel 47 (FIG. 4) of gravity actuated trap door 45 is held in its closed or sealed position on fill hopper 32. As base plate 30 approaches reversing switch 67, the switch detects the presence of the base plate, and signals drive motor 58 to stop. Thereupon, drive motor 58 will be dwelled for the appropriate and/or programmed period of time, whereupon the loading cycle will be reversed, with fill hoppers 31 and 32 being alternately positioned at feed hopper 8, and at discharge chutes 15, 16, respectively.

Figure 8:
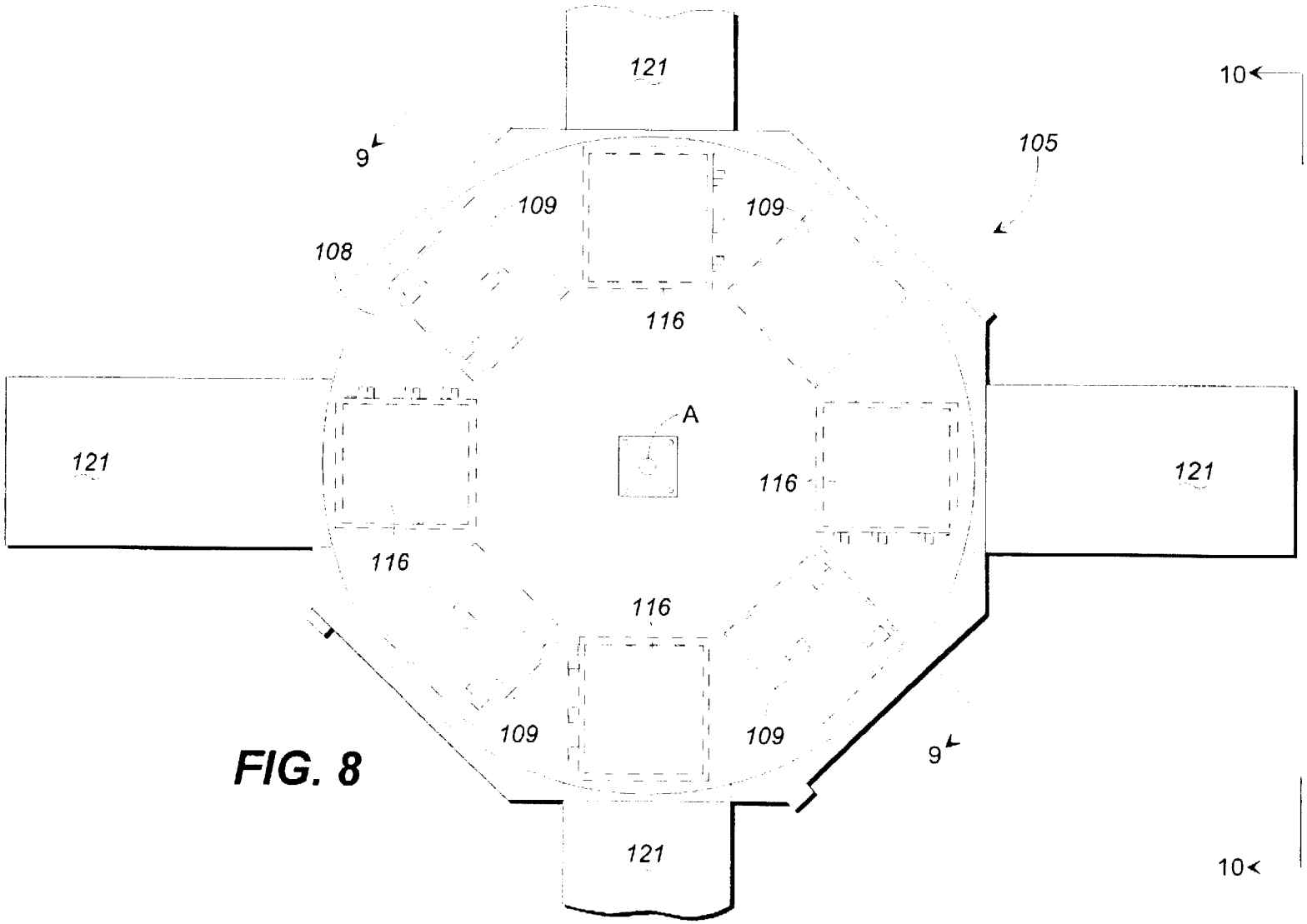
FIG. 8 is partial top plan view of a second embodiment of the improved apparatus for packaging granular materials of this invention.

A second embodiment of the granular packaging apparatus of this invention is illustrated in FIGS. 8–11. Referring first to FIG. 8, apparatus 105 is shown in a partially detailed top plan view with framework 7 removed for the purposes of clarity. Here apparatus 105 includes a feed hopper, in this instance a circular feed tub 108 in which four spaced feed openings 109 are formed. Each one of feed openings 109 is spaced 90° apart from each adjacent feed opening 109 radially about an axis of rotation, denoted by the reference character "A", and as shown in more detail in FIGS. 9 and 10.

Figure 9:
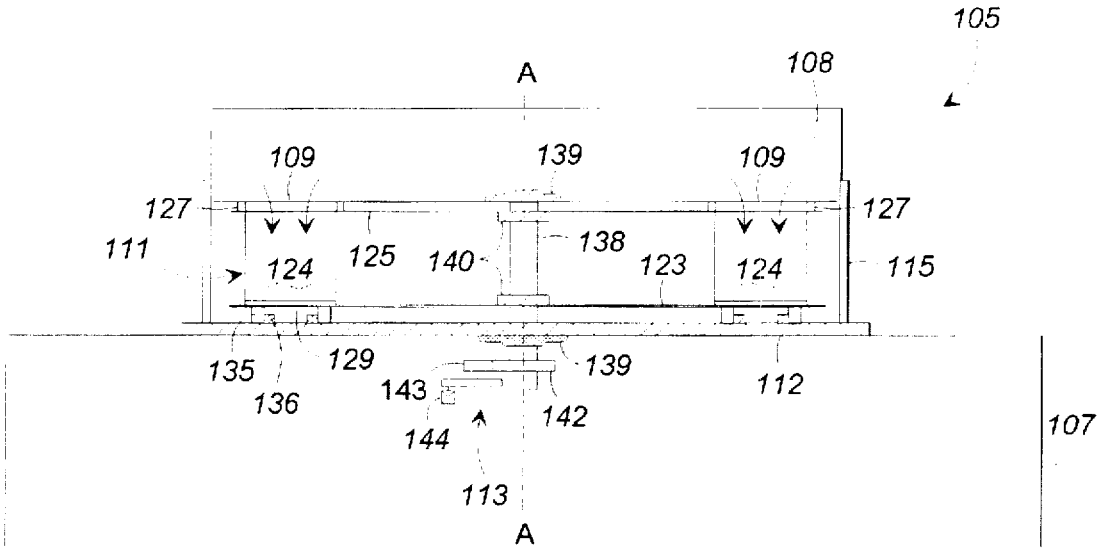
FIG. 9 is partial side elevational view along line 9—9 of FIG. 8.
Figure 10:
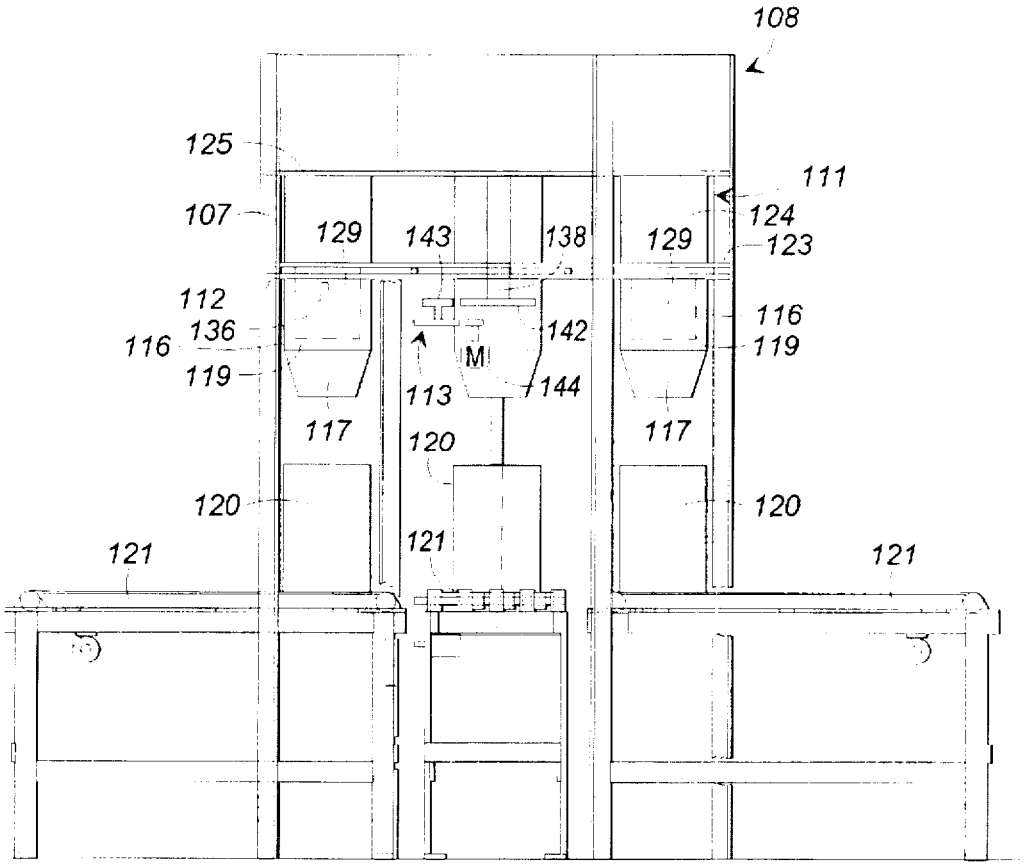
FIG. 10 is a partial side elevational view along line 10—10 of FIG. 8.
Figure 11:
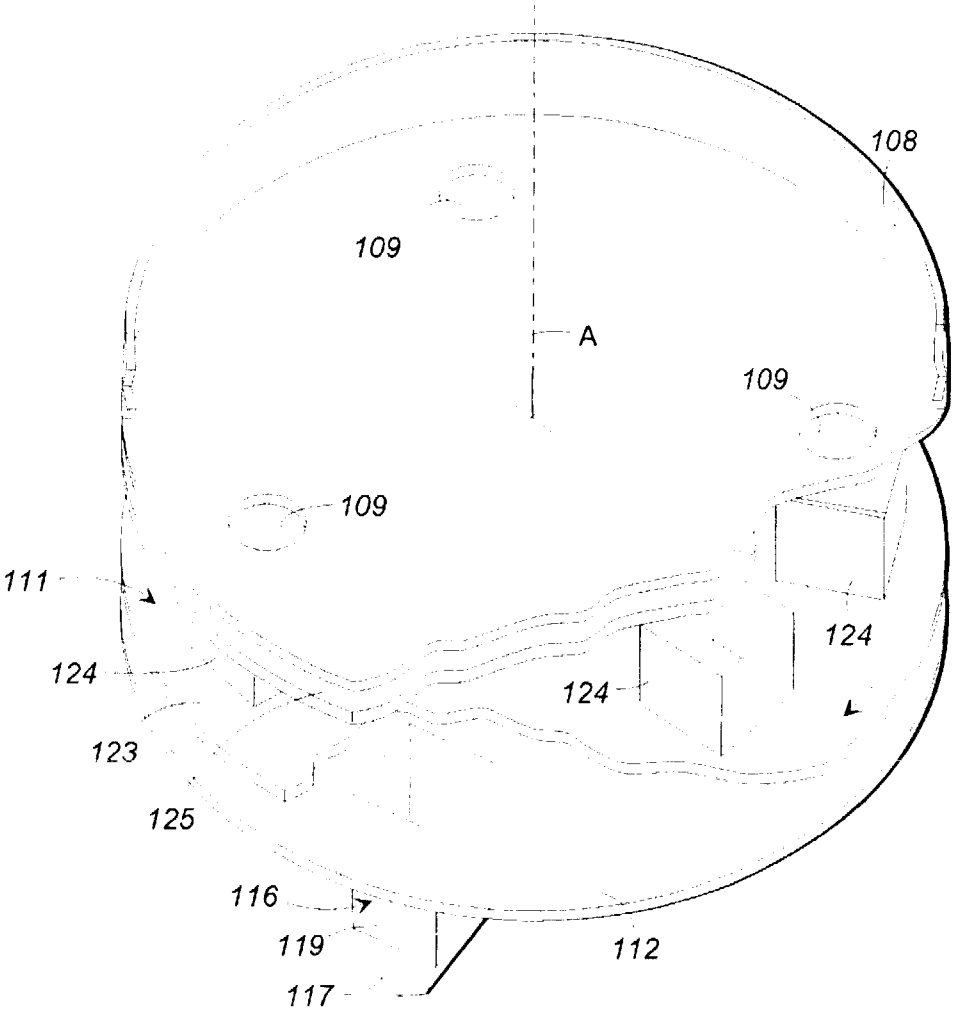
FIG. 11 is a perspective illustration of a second embodiment of the invention, with parts broken away, showing the upper portion and one side of the field hopper.

As shown in FIGS. 9, 10 and 11, apparatus 105 includes a fill hopper assembly, here constructed as a carousel 111, supported on framework 107 below feed hopper 108, and a fill hopper drive assembly 113 for rotating carousel 111 about axis of rotation A. The second embodiment of this apparatus is therefore constructed in fashion similar to the first, although a rotating carousel is used for fill hopper assembly 111 as opposed to the reciprocating dual hopper arrangement 11 illustrated in FIGS. 1–6.

Returning now to FIG. 8, and as shown generally in FIGS. 10 and 11, four discharge chutes 116 are provided in stationary plate 112 (FIGS. 9, 10 and 11) spaced equally apart from one another radially about axis of rotation A, each one of discharge chutes 116 being offset with respect to each of feed openings 109 defined in feed hopper 108. As each one of discharge chutes 16 is spaced 45° apart from each adjacent discharge chute, the offset between each discharge chute with respect to each feed opening 109 is 45°. This offset between the feed hopper openings and the discharge chutes may be varied, as desired, although an offset of 45° is preferred.

As shown in FIGS. 10 and 11, each one discharge chutes 116 includes a funnel 117 and a throat 119 constructed and arranged to guide the granular material discharged from each one of fill hoppers 124 therethrough and toward one of containers 120 held on one of conveyors 121. As opposed to the embodiment of apparatus 5, the embodiment of apparatus 105 has four conveyors 121, and is constructed to simultaneously fill four containers 120 at a time, thus allowing for greater packaging efficiency.

Fill hopper assembly of carousel 111 is illustrated in greater detail in FIGS. 9, 10 and 11. The fill hopper assembly includes a generally circular base plate 123, with eight fill hoppers 124 spaced radially about axis of rotation A, each one of fill hoppers 8 being equally spaced from each adjacent one of fill hoppers 8 about the axis of rotation, so that there is one fill hopper 124 on a 45° radial center from each adjacent one of fill hoppers 124 on base plate 123. A generally circular top plate 125 is received flush against the top peripheral edge (not illustrated) of each fill hopper 124, and used for sealing feed hopper 108, and in particular feed openings 109, thereon as the fill hopper assembly is rotated about the axis of rotation, in fashion similar to the sealing of feed hopper 8 on top plate 34 of the first embodiment of the apparatus. Accordingly, and as shown in FIGS. 9 and 10, a flexible feed hopper seal 127 is provided along the peripheral edge of each one of feed openings 109 and received on either the top peripheral edge of each one of fill hoppers 124, or received on top plate 125 for sealing the feed hopper on the top plate during the rotation of fill hopper assembly 111.

As best shown in FIG. 10, each one of fill hoppers 124 includes a gravity actuated trap door 129 constructed in fashion identical to gravity actuated trap doors 44, 45. Thus, each of gravity actuated trap doors 129 has a panel 130 fastened by a hinged connection 131 to one of the open edges of the openings (not illustrated) defined within base plate 123 and on which each one of fill hoppers 124 is mounted. Each one of panels 130 has a hinged connection 131 to base plate 123 on the leading edge (not illustrated) of each opening (not illustrated) defined in the base plate, the leading edge being the first edge to pass over one of the discharge chutes 116 as fill hopper assembly 111 is rotated about axis A. Each panel 130 is provided with a continuous edge flange 132 on which a continuous gasket 134 is mounted. Gasket 134 is constructed in fashion identical to gasket 50 for gravity actuated trap doors 44, 45. Also, and as shown in FIG. 10, each one of gravity actuated trap doors 129 includes three spaced skid plates **135*a*, 135 fastened to the bottom surface of panel 130, i.e., that surface facing stationary plate 112 when the trap door is in its closed position, as shown in FIG. 9, on each of one of fill hoppers 124. The arrangement of skid plates 135*a*, 135 on gravity actuated trap doors 129 is otherwise identical to that of skid plates 52*a*, 52 on trap doors 44, 45 of the first embodiment of this invention, and are thus not described in greater detail herein. Thus, a roller 136*a*, 136 is mounted to each one of the three skid plates 135*a*, 135 for each gravity actuated trap door 129**.

As shown in FIGS. 9 and 10, fill hopper assembly 111 is supported for rotation on framework 107 by being mounted on a central support shaft 138 received at one of its ends in a flanged bearing assembly 139 mounted on feed hopper 108, and extending through the top plate 125 and spaced base plate 123 of fill hopper assembly 111, and through stationary plate 112 where the support shaft is held in a second flanged bearing assembly 139 mounted on stationary plate 112, thus supporting the shaft for rotation on framework 107. Fill hopper assembly 111 is fixedly mounted on support shaft 138 intermediate feed hopper 108 and stationary plate 112 with a pair of hubs 140. Hubs 140 may be keyed or may use threaded fasteners, as desired. It is anticipated that fill hopper assembly 111 will be supported on support shaft 138 so that it is spaced above stationary plate 112 with rollers 136 received on the bottom of each panel 130 of each gravity actuated trap door 129 holding the trap door in its closed position, as shown in FIG. 9, when the trap door is not positioned over one of the discharge chutes 116. Moreover, each of rollers **136*a*, 136 for each closed trap door 129 is used to support the fill hopper assembly for rotation on stationary plate 112, and about the axis of rotation. As only four fill hoppers 124 can be aligned with the four discharge chutes 116 at any one time, the remaining four fill hoppers 124 will be spaced over stationary plate 112, and thus the rollers 136*a*, 136 of each such trap door 129 will be supported on stationary plate 112** for supporting the fill hopper carousel on the stationary plate.

A fill hopper drive assembly 113, illustrated in FIGS. 9 and 10, is provided for rotating fill hopper 111, and includes a drive gear 142 mounted on that portion of shaft 138 extending below stationary plate 112. An intermediate drive train or gear train 143 is engaged with drive gear 142 and is drivingly engaged with a drive motor 144 having a drive pinion engaged with the gear train for rotating support shaft 138 about the axis of rotation, thus rotating fill hopper assembly 111 on framework 107.

Apparatus 105 is operated in fashion similar to that apparatus 5 illustrated in FIGS. 1–7, with one exception. Rather than reciprocating the fill hoppers from alignment with the feed hopper and the respective discharge chutes, each one of fill hoppers 124 is rotated from a position in alignment with one of feed openings 109, a first position, into a second position in which the fill hoppers are in alignment with one of discharge chutes 116. Thus, and by way of example, referring first to FIGS. 8 and 9, a first series of every other one of fill hoppers 124 is positioned in a first position aligned with one each of feed openings 109 defined in feed hopper 108. Granular material is allowed to pass from the feed hopper into the fill hopper until such time as the fill hopper is filled, whereupon the granular material will no longer flow. Thereafter, motor 144 is actuated, either by a manual control or by a timer, motor 144 in its preferred mode being a step motor, so that support shaft 138 is rotated through ⅛ of a revolution to move the first series of fill hoppers 124 into a second position in alignment with one each of discharge chutes 116, whereupon the gravity actuated trap door 129 of each fill hopper of the first series of fill hoppers will fall downward into the discharge chute, allowing the granular material held within the fill hopper to pass through the discharge chute and toward one of containers 120.

Simultaneous with the rotation of the first series of fill hoppers 124 about the axis of rotation, a second series of fill hoppers 124 comprised of the other every other one of fill hoppers 124, is rotated from the second position into the first position in alignment with one of feed openings 109. As this is done, the gravity actuated trap door 129 of each fill hopper is passed over the leading edge (not illustrated) of each discharge chute 116, until such time as skid plates 135 strike the edge of the discharge chute opening, whereupon rollers 136 continue lifting the trap door upward and into its closed and sealed position on the bottom of each fill hopper 124 of the second series of fill hoppers, whereupon the fill hoppers complete their rotation into the first position aligned with one of feed openings 109, where the granular material is once again allowed to flow into the fill hopper in order to fill it. Thereafter, the step motor is actuated once again and the fill hopper carousel is rotated another ⅛ of a rotation so that the second series of fill hoppers is now moved into the second position in alignment with the discharge chutes 116, as the first series of fill hoppers is moved from the second position into the first position aligned with one of the feed openings 109 defined in feed hopper 108.

Fill hopper assembly 111 may be rotated intermittently about axis A, as described above, or it may also be continuously rotated about the axis of rotation if so desired. It is anticipated, therefore, that if the fill hopper assembly is being continuously rotated about axis A that it will do so at a speed of approximately one revolution per minute up to, perhaps, a speed of two revolutions per minute. So operated, it is anticipated that four containers 20 may be filled once every 30 seconds to attain a production rate of eight filled containers per minute at a rotational speed of one revolution per minute. Of course, it is also possible that improvements in technology may allow for even greater rotational operating speeds in the future.

As shown in FIGS. 8–10, fill hopper assembly 111 is rotated in a clockwise direction. Drive assembly 113 is not reversible in this embodiment of the invention as the fill hopper assembly is not being reciprocably moved on stationary plate 112. If desired, fill carousel 111 could be rotated in counterclockwise direction if gravity activated trap doors 129 were fastened to base plate 123 in opposite hand to that shown. Thus, as opposed to the embodiment of apparatus 5 in which a reciprocating motion subject to frequent stops and starts is used, here the fill carousel moves in a constant clockwise direction so that the fill hopper carousel rotates about the axis of rotation and alternately fills and discharges four fill hoppers at a time, for filling four containers at a time.

Although not illustrated in the drawings, both apparatus 5 and apparatus 105 of this invention may utilize digital control technology if so desired, so that each one of drive motors 58, 144, would be provided with a digital encoder (not illustrated), in communication with a control processor (not illustrated) in communication with a servomotor (not illustrated) for intermittently driving, i.e., powering and dwelling, fill hopper drive assembly 11, or for either intermittently or continuously driving fill hopper assembly 111 to properly position the fill hopper assemblies, respectively, with respect to feed hoppers 8, 108, respectively. Moreover, rather than using reversing switches 67, 68, with a digital control system a programmable (software) limit switch could be used as a part of the control system for signaling the position of fill hopper assembly 11 of the first embodiment of this invention with respect to feed hopper 8 and discharge chutes 15, 16, respectively, as well as the position of fill hopper assembly 111 with respect to feed opening 109 and discharge chutes 116, respectively.

While preferred embodiments of the invention have been disclosed herein, it is understood by those skilled in the art that variations and modifications thereof can be made without departing from the spirit and scope of the invention as set forth in the following claims. Moreover, the corresponding structures, materials, acts, and equivalents of all means or step plus function elements in the claimed elements are intended to include any structure, material, or acts for performing the functions in combination with other claimed elements as specifically claimed.

I claim:

1. An apparatus for packaging a generally granular material in a container, the apparatus having a framework, a feed hopper positioned on the framework with a supply of the material to be packaged in the feed hopper, and a supply of containers for receiving the material to be packaged therein, said apparatus comprising:

a fill hopper assembly supported on the framework with respect to the feed hopper, said fill hopper assembly having at least one fill hopper sized and shaped to receive the material to be packaged from the feed hopper;

at least one discharge chute positioned on the framework and being offset with respect to the feed hopper, said discharge chute being constructed and arranged to direct the material toward one of the containers; and means for moving said fill hopper assembly on the framework from a first position in which said at least one fill hopper is aligned with the feed hopper for receiving the material to be packaged therein, into a second position in which said at least one fill hopper is aligned with said at least one discharge chute for receiving the material discharged from said at least one fill hopper;

said at least one fill hopper having a gravity actuated trap door hingedly connected thereto, said trap door being constructed and arranged for movement from a generally closed position substantially sealed on said at least one fill hopper at said first position into a generally open position at said second position in response to the movement of said fill hopper assembly.

2. The apparatus of claim 1, said means for moving said fill hopper assembly being constructed and arranged to reciprocably move said at least one fill hopper from said first position into said second position and back.

3. The apparatus of claim 1, said means for moving said fill hopper assembly being constructed and arranged to rotate said fill hopper assembly along a generally circular path transversely with respect to the feed hopper so that said at least one fill hopper moves from said first position along at least a portion of said circular path into said second position.

4. An apparatus for packaging a generally granular material into one of a series of containers supplied to the apparatus, the apparatus having a framework, a feed hopper positioned on the framework, and a supply of the material to be packaged within the feed hopper, said apparatus comprising:

a fill hopper assembly supported on the framework with respect to the feed hopper, said fill hopper assembly having at least one pair of spaced fill hoppers, each of said fill hoppers being sized and shaped to receive the material to be packaged from the feed hopper;

at least one pair of spaced discharge chutes supported on the framework, each one of said at least one pair of spaced discharge chutes being offset with respect to the feed hopper and being constructed and arranged to direct the material to be packaged therethrough and toward one of the containers; and means for transversely moving each one of said at least one pair of fill hoppers with respect to the feed hopper from a first position aligned with the feed hopper into a second position aligned with one of said at least one pair of discharge chutes;

each of said fill hoppers having a gravity actuated trap door hingedly connected thereto, each said trap door being constructed and arranged for movement from a generally closed position substantially sealed on each one of said at least one pair of fill hoppers, respectively, in said first position into a generally open position at said second position in response to the transverse movement of said at least one pair of fill hoppers for allowing the material carried within each of said at least one pair of fill hoppers to be emptied into one of said at least one pair of discharge chutes.

5. The apparatus of claim 4, wherein said means for transversely moving each one of said at least one pair of fill hoppers is constructed and arranged to reciprocably and alternately position each one of said at least one pair of spaced fill hoppers in alignment with the feed hopper in said first position.

6. The apparatus of claim 4, wherein said means for transversely moving each one of said at least one pair of fill hoppers is constructed and arranged to alternately align each one of said at least one pair of spaced fill hoppers with the feed hopper at said first position while simultaneously and alternately aligning the other one of said at least one pair of spaced fill hoppers with one of said at least one pair of discharge chutes at said second position.

7. The apparatus of claim 4, said fill hopper assembly further comprising a generally rectangular base plate, said at least one pair of spaced fill hoppers being mounted on said base plate and extending to a top plate spaced from said base plate, said top plate extending between each one of said at least one pair of spaced fill hoppers and being substantially flush with an upper peripheral edge of each one of said at least one pair of fill hoppers.

8. The apparatus of claim 7, wherein said means for transversely moving each one of said at least one pair of fill hoppers is constructed and arranged to move said base plate transversely with respect to the feed hopper so that each of said at least one pair of spaced fill hoppers is reciprocably moved toward and away from said feed hopper.

9. The apparatus of claim 7, said system further comprising:

a stationary plate mounted on the framework for supporting said fill hopper assembly thereon, said stationary plate having a spaced pair of generally parallel and elongated guide rails mounted thereon;

said fill hopper assembly including two spaced and generally parallel spaced series of support wheels mounted on the base plate thereof and being received on one each on said guide rails, respectively, for guiding the fill hopper assembly on the stationary plate;

at least one gear rack mounted on said base plate; and at least one drive gear mounted on the stationary plate and being engaged with said at least one gear rack.

10. The apparatus of claim 9, said means for transversely moving each one of said at least one pair of fill hoppers further comprising a reversible drive assembly mounted on the framework, said drive assembly being constructed and arranged to power said at least one drive gear; and a pair of reversing switches spaced from one another on said stationary plate, each said reversing switch being constructed and arranged to reverse the direction of said drive assembly in response to the detection of said fill hopper assembly thereby as said fill hopper assembly is being moved on said framework by said reversible drive assembly.

11. The apparatus of claim 10, each of said reversing switches including a time delay mechanism constructed and arranged to delay the operation of said reversible drive assembly when the fill hoppers of said at least one pair of fill hoppers are at said first position and at said second position, respectively.

12. The apparatus of claim 7, wherein the feed hopper of said system is constructed and arranged to be sealed against the top plate of said fill hopper assembly as the fill hoppers of said at least one pair of fill hoppers are transversely moved from said first position to said second position.

13. The apparatus of claim 4, wherein said means for transversely moving each one of the at least one pair of fill hoppers is constructed and arranged to move each one of said at least one pair of fill hoppers along a generally circular path with respect to the feed hopper so that each one of said at least one pair of spaced fill hoppers is moved from said first position along at least a portion of said circular path into said second position.

14. The apparatus of claim 4, said fill hopper assembly further comprising:

a generally circular base plate formed about an axis of rotation positioned with respect to the feed hopper;

a generally circular top plate formed about said axis and spaced from said base plate; and eight spaced fill hoppers positioned radially about said axis and extending from said base plate to said top plate, each of said fill hoppers defining a fill hopper opening in said top plate therefor and being spaced equally apart from each adjacent one of the eight fill hoppers radially about said axis.

15. The apparatus of claim 14, further comprising:

a stationary plate mounted on the framework for rotatably supporting said fill hopper assembly thereon;

the feed hopper including a feed hopper distribution plate formed about the axis of rotation of said fill hopper assembly, said distribution plate having four feed openings defined therein and being spaced equally apart from one another radially about said axis;

wherein said fill hopper assembly is positioned on the framework beneath said distribution plate;

and wherein said stationary plate has four discharge chutes depending therefrom, said discharge chutes being equally spaced equally from one another radially about said axis and being offset with respect to said feed openings in the distributor plate.

16. The apparatus of claim 15, wherein every other one of said eight fill hoppers comprises a first series of fill hoppers, said first series of fill hoppers being aligned with one each of said feed openings at said first position, respectively, for receiving the material to be packaged therein, said means for moving each one of said at least one pair fill hoppers being constructed and arranged to move the fill hoppers of said first series of fill hoppers into alignment with one each of said discharge chutes at said second position, respectively, as the fill hoppers of a second series of fill hoppers comprised of the other every other one of said eight fill hoppers is simultaneously moved into alignment with one each of feed openings at said first position.

17. The apparatus of claim 16, further comprising a time delay mechanism constructed and arranged to delay the movement of said first series of fill hoppers and said second series of fill hoppers, respectively, at said first position and at said second position, respectively.

18. The apparatus of claim 14, wherein the feed hopper of said system is constructed and arranged to be sealed against the top plate of said fill hopper assembly as said fill hopper assembly is rotated about the axis of rotation.

19. The apparatus of claim 14, further comprising:

a stationary plate mounted on the framework, said fill hopper assembly being supported on said stationary plate for rotation; and an elongated support shaft disposed along the axis of rotation, said support shaft being journaled on the feed hopper and extending through said fill hopper assembly, said shaft being fastened to said top plate and to said base plate of the fill hopper assembly, and extending from said base plate through said through said stationary plate and being journaled on said stationary plate;

wherein the gravity actuated trap doors of each one of said eight fill hoppers includes a spaced pair of skids on each of which a roller wheel is supported for rotation, each of said roller wheels being engaged on said stationary plate when the respective gravity actuated trap doors of said fill hoppers are in their closed positions on said fill hopper assembly for supporting said fill hopper assembly on the stationary plate as the fill hopper assembly is rotated about said axis;

and wherein said means for transversely moving the eight fill hoppers of said fill hopper assembly comprises a drive gear mounted on said support shaft below said stationary plate and a drive motor assembly supported on the framework and being drivingly engaged with said drive gear for rotating said fill hopper assembly about said axis.

20. A method of filling a container with a generally granular material in a packaging apparatus, the apparatus having a framework, a feed hopper positioned on the framework, a supply of the material to be packaged in the feed hopper, and a supply of containers to be filled, said method comprising the steps of:

positioning a fill hopper assembly on the framework with respect to the feed hopper, said fill hopper assembly having at least a first fill hopper sized and shaped to receive the material to be packaged from the feed hopper;

aligning said first fill hopper with the feed hopper at a first position, said first fill hopper having a gravity actuated trap door hingedly connected thereto and being held in a generally closed position substantially sealed thereon at said first position;

transferring a first amount of the material from the feed hopper into said first fill hopper;

moving said first fill hopper from said first position into a second position in which said first fill hopper is aligned with a first discharge chute supported on the framework and spaced from the feed hopper, and opening the trap door of said first fill hopper from said closed position into a generally open position in response thereto; and discharging the first amount of material from the first fill hopper into the first discharge chute and into one of the containers in response thereto.

21. The method of claim 20, further comprising the step of sealing the feed hopper on said fill hopper assembly as said first fill hopper is moved from said first position to said second position.

22. The method of claim 20, further comprising the steps of providing a second fill hopper as a part of said fill hopper assembly, said second fill hopper having a gravity actuated trap door hingedly connected thereto and being held thereon in a generally closed position substantially sealed thereon at said first position, and simultaneously moving said second fill hopper into alignment with the feed hopper at said first position as said first fill hopper is moved into said second position.

23. The method of claim 22, further comprising the steps of:

simultaneously transferring a second amount of the material from the feed hopper into said second fill hopper as said first fill hopper is in said second position;

moving said first fill hopper back into said first position and moving the trap door of said first fill hopper from said open position into said closed position in response thereto;

simultaneously aligning said second fill hopper with a second discharge chute spaced from said first discharge chute in response thereto and moving the gravity actuated trap door of said second fill hopper from said closed position into said open position in response thereto; and discharging the second amount of material from the second fill hopper into the second discharge chute and into one of the containers in response thereto.

24. The method of claim 20, wherein the step of moving said first fill hopper on the framework from said first position into said second position comprises the step of reciprocably moving said first fill hopper into and out of alignment with the feed hopper.

25. The method of claim 20, wherein the step of moving said first fill hopper from said first position to said second position comprises the step of transversely rotating said fill hopper assembly about an axis of rotation positioned on the framework with respect to the feed hopper.

26. The method of claim 25, further comprising the steps of:

a) providing eight fill hoppers on said fill hopper assembly, said fill hoppers being spaced equally apart from each adjacent one of said eight fill hoppers radially about said axis;

b) providing four feed openings in the feed hopper with respect to said fill hopper assembly, said feed openings being spaced equally apart from one another radially about said axis;

c) providing four discharge chutes on the framework positioned with respect to said fill hopper assembly, said discharge chutes being offset from said feed openings and being spaced equally apart from one another radially about said axis;

d) aligning a first series of fill hoppers comprising every other one of said eight fill hoppers with said feed openings at said first position;

e) transferring a first amount of material from the feed hopper into said first series of fill hoppers;

f) rotating said fill hopper assembly so that said first series of fill hoppers is aligned with one each of said discharge chutes at said second position and opening the gravity actuated trap door of each of the fill hoppers of said first series of fill hoppers in response thereto;

g) simultaneously positioning a second series of fill hoppers comprising the other every other one of said eight fill hoppers in alignment with each of said feed openings at said first position; and h) discharging said first amount of material from said first series of fill hoppers into separate ones of the containers as a second amount of the material is transferred from the feed hopper into said second series of fill hoppers.

27. The method of claim 26, further comprising the steps of:

a) rotating said fill hopper assembly so that said second series of fill hoppers is aligned with one each of said discharge chutes at said second position and opening the gravity actuated trap door of each of the fill hoppers of said second series of fill hoppers in response thereto;

b) simultaneously moving the fill hoppers of said first series of fill hoppers into alignment with each of said feed openings at said first position and moving the trap door of each of the fill hoppers of said first series of fill hoppers into said closed position in response thereto; and c) discharging said second amount of material from said second series of fill hoppers into separate ones of the containers as a third amount of the material is transferred from the feed hopper into said first series of fill hoppers.

* * * * *